United States Patent [19]

Oakes et al.

[11] 4,320,156

[45] Mar. 16, 1982

[54] INTIMATE MIXTURES OF REFRACTORY METAL CARBIDES AND A BINDER METAL

[75] Inventors: James J. Oakes, Murfreesboro, Tenn.; William Scheithauer, Jr., Sayre, Pa.

[73] Assignee: GTE Products Corporation, Stamford, Conn.

[21] Appl. No.: 224,368

[22] Filed: Jan. 12, 1981

[51] Int. Cl.[3] ..... F16H 13/10

[52] U.S. Cl. ..... 427/213; 75/252; 366/101

[58] Field of Search ..... 75/252, 242, 239; 366/101; 427/213; 106/43

[56] References Cited

U.S. PATENT DOCUMENTS 4,168,913 9/1979 Kono ..... 366/101

*Primary Examiner*—Sam Silverberg

*Attorney, Agent, or Firm*—Robert E. Walter

[57] ABSTRACT

A uniform mixture of refractory metal carbide, binder metal and a pressing aid is achieved by fluidizing the mixture.

2 Claims, No Drawings

INTIMATE MIXTURES OF REFRACTORY METAL CARBIDES AND A BINDER METAL

BACKGROUND

This invention relates to refractory metal carbides and cemented carbides. More particularly, it relates to a method for preparing uniform mixtures of a refractory metal carbide or carbides and a binder metal system.

PRIOR ART

In the conventional manufacture of cemented carbides, powder particles of a refractory metal carbide such as tungsten carbide, titanium carbide, tantalum carbide or mixtures or solid solutions thereof are ball-milled with a binder metal such as cobalt, iron or appropriate alloys for a prolonged period of time in order to achieve an intimate mixture of the components. An organic liquid, such as acetone, hexane, heptane and the like, is added to protect the powders during milling and sometimes to aid in the milling operation. Sometimes a wax binder material is added either prior to or during milling. After milling the organic has to be removed, usually by evaporation, prior to forming into shapes. If the wax is not added before the end of milling, it must be added prior to forming. The wax enables the powders to be granulated into a free flowing form and pressed into a desired shape by acting as a lubricant and by providing the strength necessary for the presses part to retain its shape. The pressed part is then dewaxed generally in a thermal cycle to remove the wax and any residual organic. If machining of the green part is required, the part is first presintered after the dewaxing operation to impart additional strength to the part to tolerate the machining operation. After machining, the material is sintered in hydrogen, disassociated ammonia, or a vacuum at a sufficient temperature to achieve liquid phase sintering and full densification.

During the foregoing processing steps, in particular the milling operation, the average particle size of the refractory metal carbide can be reduced by comminution. It is, however, possible during sintering, by some of the mechanisms that are operative, to regain some of this loss in particle size. As a result of this mechanism which occurs during sintering, the average size of the refractory metal carbide grains in the cemented carbide after sintering can be smaller, the same, or larger than the average particle size of the carbide prior to milling. However, it is generally accepted that the loss of size by comminution during milling is nonrecoverable during the sintering operation.

More recently there has developed a market for materials containing a homogeneous mixture of the refractory metal carbide and the binder metal along with the wax. These materials, after preparing the mixtures and performing the waxing and granulating operations, are known in the trade as "grade powders". They are used by cemented carbide manufacturers in lieu of having in-house facilities for preparing the mixtures and performing the waxing and granulating operations. The milling portion of grade powder preparation has been done typically by ball milling, attritor milling or vibratory milling. Generally, the higher energy milling methods result in more comminution of the refractory metal carbides.

It is believed, therefore, that a process for preparing homogeneous mixtures of a refractory metal carbide and a compatible binder metal that enables retention of the maximum particle size achievable by the starting refractory metal carbide powders and a substantial reduction in the time and operations required to achieve the homogeneous mixture would be an advancement in the art.

SUMMARY OF THE INVENTION

In accordance with one aspect of this invention, there is provided a method for producing a homogeneous mixture of a refractory metal carbide and a binder metal. A wax to enable appropriate granulation and to accomplish the pressing operation with regard to shape and strength can also be included if desired. The foregoing mixtures are achieved by introducing particles of the refractory metal carbide and particles of the binder metal into a confined chamber to form a bed. A flow of fluidizing gas that is appropriate to the refractory metal carbide and the binder metal is directed upwardly through the bed with sufficient mass velocity to maintain the bed in a turbulent fluidized state. Times required to achieve adequate mixing by this method are determined by the quality and properties of the finished product and are generally quite short. Times of from about 5 to about 10 minutes appear to be sufficient although longer times can be used. If desired, after mixing, a wax solution can be sprayed onto the fluidized bed which results in a uniform distribution of the wax and enables the particles to granulate to form a free-flowing admixture. A homogeneous mixture of the wax, refractory metal carbide and binder metal is generally achieved within about five minutes although longer times can be used.

This invention describes a process for combining metal cementing binder and refractory carbide powders with an organic admixture to produce a free-flowing "waxed" grade powder from which cemented carbide parts can be made by conventional methods. The process above is capable of combining the constituents of the grade powder without the traditional milling process. In our process, the intimate mixture of the carbide and metal binder powders necessary for high quality cemented carbide manufacture is achieved by dry mixing in a fluidized bed rather than mixing in a ball or attritor mill where a milling fluid is needed. This feature eliminates the need to dry the powder after milling and eliminates possible sources of contamination. Additional ingredients can be introduced into the fluidized bed of metal and carbide powders to cause agglomeration of the individual particles yielding a free-flowing powder similar to those produced by traditional methods. Agglomeration in the traditional process is done in a separate operation from mixing.

DETAILS OF THE PREFERRED EMBODIMENTS

For a better understanding of the present invention, together with other and further objects, advantages and capabilities thereof, reference is made to the following portion of the specification in connection with the foregoing description of the prior art and summary of the invention.

Refractory metal carbides generally include tungsten carbide, titanium chloride, molybdenum carbide, tantalum carbide, hafnium carbide, mixtures and solid solutions of the foregoing carbides. The binder metal normally used in the production of cemented carbides is cobalt, however, in some instances nickel, iron or combinations of the foregoing iron group metals can be used. While the foregoing refractory metal carbides and binder metals are commonly used, other materials in minor amounts can be added for particular purposes such as chromium, vanadium, molybdenum, the rare earths, etc. In the practice of the present invention, any of the materials used to make cemented carbides can be utilized.

The mass gas velocity, e.g. the weight of gas per unit of cross-sectional area in the chamber, required to maintain the bed in a fluidized state is dependent upon several factors. Some of the more important factors include the physical characteristics of the individual particles of the refractory metal carbide and the metal binder. The physical characteristics of the fluidizing gas also are important. The size, density, shape, size distribution and roughness of the particles of both solids have a bearing upon the mass gas velocity. The density and viscosity of the fluidizing gas will also have a bearing upon the mass gas velocity required. As is well known in the art, smaller and less dense particles require less gas to fluidize than larger and more dense particles. Additionally smooth spheres are more easily suspended than are irregular rough surfaces. Ideally, all particles should be the same size. Since this is not practicable, a relatively narrow particle size is desirable to avoid excessive entrainment of small particles while maintaining the larger particles in a fluidized state. The more dense and viscous the gas, the less mass velocity is required.

During fluidization, an organic mixture such as a commerically available pressing aid in liquid form may be metered into the bed to enhance the free flowing properties of the final powder. "Carbowax" which is a trade name for a commercially available polyethylene glycol is one such pressing aid.

The particle size of the refractory metal carbides generally range from about 0.9 to about 30 microns. Even though the individual particles are quite dense, on the order of 15 g/cc., mass velocities required are not excessive. Generally when air is used a mass velocity of from 60 to about 150 lbs/per hour/square foot is sufficient.

EXAMPLE

Tungsten carbide powder, Grade SC-140, and cobalt powder, AMXF Grade NR 742 are loaded into an Aeromatic WSG5 Fluid Bed Unit of the type where the powder mixture is suspended in a air stream by the air flow though the bed of material. The mass gas velocity is sufficient to maintain the particle charge in a fluid state for about a five minute period after which a water and wax solution was atomized over the bed. A solution of 150 grams of Carbowax 20,000 per liter of water was sprayed into the five killogram charge at the rate of about 50 militers per minute during subsequent fluidization. The resulting powder had good free flowing properties and bulk density greater than 3.36 g/cc. Cemented carbides made from the powders by pressing and sintering were evaluated as to density, hardness and porosity and were found to have excellent properties.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a relatively homogeneous mixture of refractory metal carbide and a binder metal comprising the steps (1) introducing a nonhomgeneous mixture consisting essentially of particles of said refractory metal carbide and particles of said binder metal into a confined chamber to form a bed, (2) directing a stream of a gas to said refractory metal carbide and said binder metal through said bed at a sufficient mass velocity to maintain said bed in a fluidized turbulent state without an appreciable entrainment of said particles in said gas as said gas exits from said bed and (3) maintaining said bed in a fluidized condition for at least about 5 minutes.

2. A process for producing a relatively homogeneous mixture of a refractory metal carbide and a binder metal comprising the steps of: (1) introducing a nonhomogeneous mixture consisting essentially of particles of said refractory metal carbide particles of said binder metal into a confined chamber to form a bed; (2) directing a stream of a gas to said refractory metal carbide and said binder metal through said bed at a sufficient velocity to maintain said bed in a fluidized turbulent state without an appreciable entrainment of the particles in said gas as said gas exits from said bed; (3) maintaining said bed in a fluidized condition for at least about 10 minutes; and (4) spraying a sufficient amount of an aqueous solution of a pressing aid onto said bed while in a fluidized state to achieve a concentration of pressing aid of from about 1.5% to about 4.5% by weight of said homogeneous mixture, and (5) maintaining said bed in a fluidized state for at least about 20 minutes after all of said solution has been added to said bed.

* * * * *